US009032559B2

(12) United States Patent
Aziz et al.

(10) Patent No.: US 9,032,559 B2
(45) Date of Patent: May 19, 2015

(54) PROTECTIVE DEVICE

(75) Inventors: Usama Aziz, Stockholm (SE); Musse Hasselvall, Stockholm (SE)

(73) Assignee: Frontlife AB, Stockholm (SE)

( * ) Notice: Subject to any disclaimer, the term of this patent is extended or adjusted under 35 U.S.C. 154(b) by 0 days.

(21) Appl. No.: 13/703,096

(22) PCT Filed: May 9, 2011

(86) PCT No.: PCT/SE2011/050579

§ 371 (c)(1),
(2), (4) Date: Dec. 10, 2012

(87) PCT Pub. No.: WO2011/155889

PCT Pub. Date: Dec. 15, 2011

(65) Prior Publication Data

US 2013/0091625 A1 Apr. 18, 2013

(30) Foreign Application Priority Data

Jun. 11, 2010 (SE) ..... 1050598

(51) Int. Cl.
*A41D 13/05* (2006.01)
*A63B 71/12* (2006.01)

(52) U.S. Cl.
CPC ..... *A41D 13/05* (2013.01); *A63B 71/1216* (2013.01)

(58) Field of Classification Search
CPC ..... A41D 13/05; A63B 71/1216
USPC ..... 2/455, 456, 463, 464, 22, 227, 403, 2/466, 404
See application file for complete search history.

(56) References Cited

U.S. PATENT DOCUMENTS

| | | | | |
|---|---|---|---|---|
| 436,518 | A | 9/1890 | Dent | |
| 792,424 | A * | 6/1905 | King | 128/96.1 |
| 849,471 | A * | 4/1907 | Gamble | 602/72 |
| 1,019,501 | A * | 3/1912 | Love et al. | 128/100.1 |
| 1,469,069 | A * | 9/1923 | Freedenberg | 450/114 |
| 1,691,658 | A * | 11/1928 | Kennedy | 602/70 |
| 1,720,439 | A * | 7/1929 | Richardson | 2/466 |

(Continued)

FOREIGN PATENT DOCUMENTS

DE 3610926 10/1987

OTHER PUBLICATIONS

International Search Report for International Application No. PCT/SE2011/050579, mailed Sep. 26, 2011, 4 pages.

(Continued)

*Primary Examiner* — Danny Worrell
(74) *Attorney, Agent, or Firm* — Nixon Peabody LLP

(57) ABSTRACT

Protective equipment for protection of a user's lower abdominals includes a protective cup with upper and lower parts, a waist strap arranged to engage with and retain the protective cup on the user's body in a position where the protective cup hangs down with its lower part downwards and covers the user's genital body parts, a leg strap device, arranged to engage with and retain the protective cup in a position close to the user's body, the leg strap device including two leg strap parts, arranged to run around each leg of the user. The leg strap device engages with and runs from at least one lower engagement means in the protective cup's lower part, and backwards between the user's legs. The leg strap parts run up to and engage with the protective cup at at least one upper engagement means in the protective cup's upper part.

17 Claims, 4 Drawing Sheets

(56) References Cited

U.S. PATENT DOCUMENTS

| | | | | | |
|---|---|---|---|---|---|
| 2,424,462 | A | | 7/1947 | Hoey | |
| 2,593,262 | A | * | 4/1952 | Calabrese | 128/96.1 |
| 2,815,023 | A | * | 12/1957 | Hammersley | 128/99.1 |
| 3,176,686 | A | * | 4/1965 | Barnes | 128/846 |
| 3,782,375 | A | * | 1/1974 | Donars | 602/72 |
| 4,059,103 | A | * | 11/1977 | Glaser | 128/96.1 |
| 4,453,541 | A | * | 6/1984 | Castelli et al. | 602/72 |
| 4,922,899 | A | * | 5/1990 | Graff et al. | 602/72 |
| 4,989,594 | A | * | 2/1991 | Doherty et al. | 602/72 |
| 5,249,306 | A | * | 10/1993 | Morris | 2/466 |
| 5,547,466 | A | * | 8/1996 | McRoberts et al. | 602/70 |
| 5,778,888 | A | * | 7/1998 | Sheehy | 128/846 |
| 6,048,327 | A | * | 4/2000 | Kieffer | 602/70 |
| D503,511 | S | * | 4/2005 | Glisson et al. | D2/711 |
| 7,216,371 | B2 | * | 5/2007 | Wong | 2/228 |
| 7,418,743 | B2 | * | 9/2008 | Tsujimoto | 2/466 |
| 7,757,310 | B2 | * | 7/2010 | Wong | 2/466 |
| 8,336,120 | B2 | * | 12/2012 | Wong | 2/238 |
| 2002/0023578 | A1 | * | 2/2002 | Wolf | 112/237 |
| 2005/0177931 | A1 | * | 8/2005 | Tsujimoto | 2/466 |
| 2008/0262404 | A1 | | 10/2008 | McKenzie | |
| 2010/0275349 | A1 | * | 11/2010 | Wilson, II | 2/466 |

OTHER PUBLICATIONS

Written Opinion for International Application No. PCT/SE2011/050579, mailed Sep. 26, 2011, 4 pages.

European Search Report for European Application No. 11792742.6 dated Apr. 4, 2014, 6 pages.

* cited by examiner

PROTECTIVE DEVICE

CROSS-REFERENCE TO RELATED APPLICATIONS

This application is a U.S. National Stage of International Application No. PCT/SE2011/050579, filed May 9, 2011, which claims the benefit of Sweden Application No. 1050598-0, filed Jun. 11, 2010, both of which are incorporated herein by reference in their entireties.

TECHNICAL FIELD

The present invention relates to a protective device for protection of the lower abdomen of a user during the practice of sport.

BACKGROUND

During the practice of many sports, such as various martial arts but also soccer, rugby, some cycling disciplines and so on, there is a risk for violence towards the lower abdomen of the user. Therefore, protective equipment such as a jockstrap is traditionally used.

A conventional jockstrap typically comprises a protective, hard cup, the edges of which abut against the body of the user and cover the genital body parts of the same, as well as a waist strap keeping the cup in position. Often, leg straps are also used, tightening the protective cup additionally by tensional force around the legs.

Such jockstraps are, for example, described in US 2005/0177931 A1, DE 20003838 U1 and CA 2462208.

There are also jockstraps of so-called thai type, comprising a groin strap running from the protective cup to the waist strap.

A problem with conventional jockstraps is that they in many cases display poor fit, especially during intensive movements of the user. Moreover, there is often a play between the protective cup and the user's body, depending on body position. Thai jockstraps are often conceived as uncomfortable.

In order to avoid injuries, it is very important that the fit is always satisfactory during sport practice, and that such play does not arise.

Furthermore, some jockstrap designs are complex and therefore expensive to manufacture.

SUMMARY

The present invention solves the above described problems.

Thus, the invention relates to a protective equipment for protection of the lower abdominals of a user, comprising a protective cup with an upper and a lower part, a waist strap arranged to engage with and retain the protective cup on the user's body in a position in which the protective cup hangs down with its lower part downwards and covers the genital body parts of the user, as well as a leg strap device, arranged to also engage with and retain the protective cup in a position close to the user's body, which leg strap device comprises two leg strap parts, arranged to run around one respective leg of the user each, and is characterized in that the leg strap device is arranged to engage with and run from at least one lower engagement means, arranged in the lower part of the protective cup, and backwards between the user's legs, and in that the leg strap parts are arranged to run up to and engage with the protective cup at at least one upper engagement means, arranged in the upper part of the protective cup.

The invention will now be described in detail, with reference to exemplifying embodiments of the invention and the appended drawings, where:

DETAILED DESCRIPTION

Figure 1B:
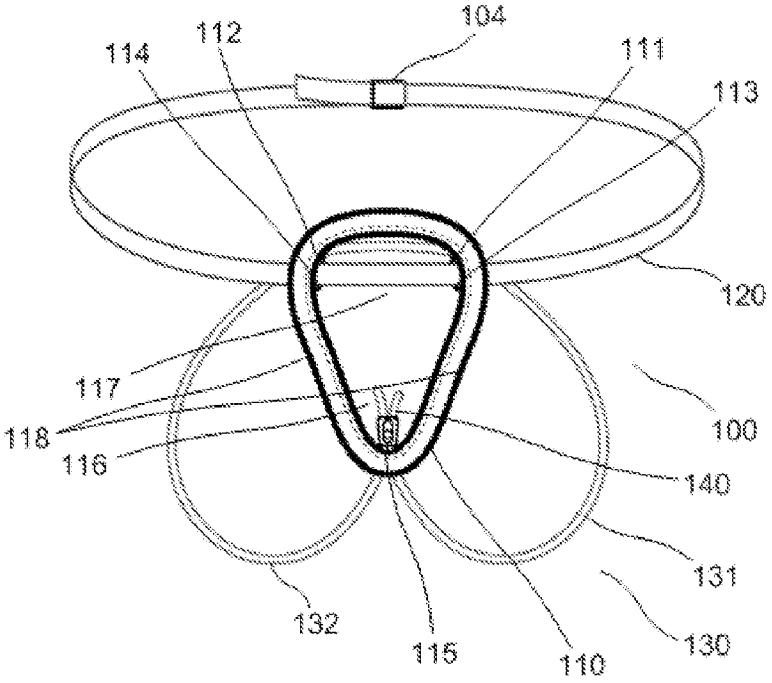
FIGS. 1*b*, 2*b*, 3*b* and 4*b*, respectively, show a back view of a protective device according to a first, a second, a third and a fourth preferred embodiment, respectively, of the present invention.
Figure 1A:
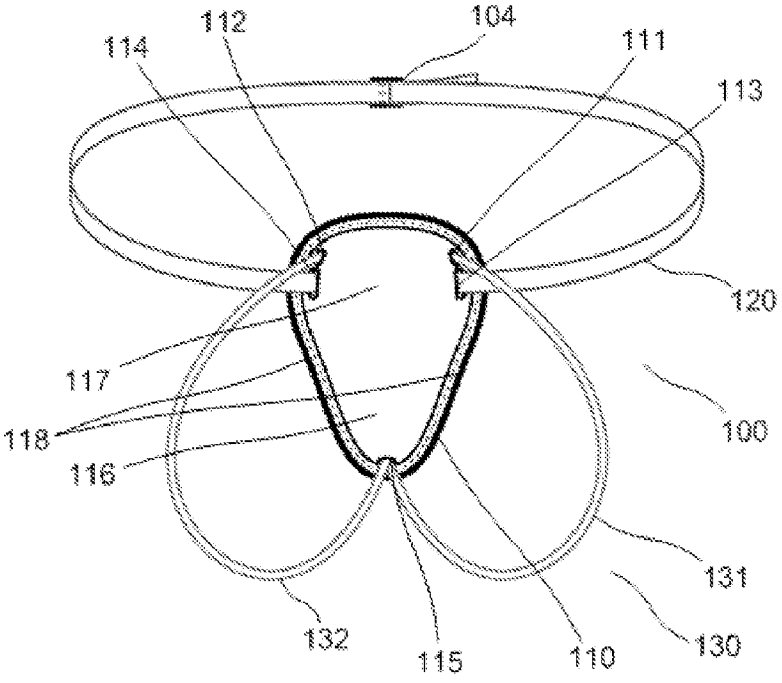
FIGS. 1*a*, 2*a*, 3*a* and 4*a*, respectively, show a front view of a protective device according to a first, a second, a third and a fourth preferred embodiment, respectively, of the present invention.

FIG. 1*a* shows a protective device 100 according to the present invention for protecting the lower abdomen of a user. The protective device further comprises a protective cup 110, manufactured from a hard and wear resistant material such as rigid plastic. The protective cup 110 is arranged to be positioned over and thereby to protect the genital body parts of the user. Its edges are arranged to abut against the user's body. The protective cup 110 comprises, in the orientation illustrated in the figures, a lower part 116 and an upper part 117.

The protective cup 110 which is illustrated in FIGS. 1*a* and 1*b* is primarily designed for male users, but it is realized that a protective equipment according to the present invention also is useful for women. In this latter case, the shape of the protective cup 110 is modified in a suitable way.

It is preferred that the protective cup 110 has an overall configuration which is essentially triangular, where the lower part firstly comprises a pointed end at its lower edge, and secondly is symmetrical about an essentially vertical symmetry plane in the orientation shown in the figures. Hence, this means that the lower part 116 has a shape which is narrowed downwards, away from the upper part 117, and the upper part 117 comprises a finish upwards which is substantially wider than the downwards finish of the lower part 116.

In order to keep the protective cup 110 in place against the body of the user in a position in which the protective cup 110 hangs with the lower part 116 downwards, and so that the protective cup 110 covers the lower abdominals of the user, there is a waist strap 120 arranged. The waist strap 120 can be elastic or inelastic, and preferably comprises a tightening device 104.

Furthermore, the protective cup 110 comprises a leg strap device 130, the purpose of which also, as is the case with the waist strap 120, is to retain the protective cup 100 in the correct position. The leg strap device 130 comprises two leg strap parts 131, 132, arranged to run around one respective leg of the user each and thereby to retain the protective cup 100 in a position up against the user's body.

According to the invention, the leg strap device 130 is arranged to engage with and run from at least one lower engagement means 115, arranged at the lower part 116 of the protective cup 110, and backwards between the user's legs. This means that the leg strap device 130 can comprise a groin part (not shown), which is fastened to or otherwise engages with the at least one engagement means 115, and to which both leg strap parts are fastened, preferably at a common fastening point from which the leg strap parts are arranged to run in one respective direction each about one respective leg each. Alternatively, as shown in FIGS. 1*a*, 1*b*, both leg strap parts 131, 132 may engage with the at least one engagement means 115. That the leg strap device 130 is arranged to "engage with" the engagement means 115 means that the leg strap device 130 is permanently or removably, possibly adjustably, fastened to the engagement means 115; that the leg strap device 130 is in slidable engagement with the engagement means 115, for example that a strap part comprised in the leg strap device 130 runs through a loop or a hole of the engagement means 115; or that the leg strap device 130 in another way engages with the engagement means 115 in such a way so that the lower part 116 of the protective cup 110, as a consequence of the engagement and a tension applied across the leg strap device 130, is arranged to be pressed inwards against the user's body in a backwards direction in relation to the user when he or she carries the protective device 100.

Moreover, according to the invention the leg strap parts 131, 132 are arranged to run up to and engage with the protective cup 110 at at least one upper engagement means, arranged in the upper part 117 of the protective cup 110. In a way which corresponds to the engagement between the leg strap device 130 and the engagement means 115 as described above, the engagement between the leg strap parts 131, 132 of the leg strap device 130 and the upper engagement means may be arranged in different ways, so long as the engagement serves the purpose of, via a tensional force in the leg strap device 130, pressing the protective cup 110 inwards against the user's body. In the exemplifying protective cup 100 illustrated in FIGS. 1*a* and 1*b*, the upper engagement means is a pair of through holes 111, 112 in the protective cup 110, see below.

Since the leg strap device 130 engages with the protective cup 110 both at the lower part 116 and at the upper part 117, between which engagement points the leg strap parts 131, 132 run around the user's respective legs, a number of advantages are achieved.

Hence, an improved fit as compared to conventional jockstraps is achieved. Since the protective cup 110 is pressed inwards against the user's body both at its lower part 116 and its upper part 117, the risk for there being a play between the cup 110 and the user's body decreases, also during intensive and/or extreme movements.

Furthermore, improved user comfort is achieved.

Also, these advantages may be achieved in a simple way, without complex and therefore expensive construction details, which will be clear from the following.

According to a preferred embodiment, illustrated in FIGS. 1*a* and 1*b*, both leg strap parts 131, 132 are two parts of the same leg strap. In other words, the first leg strap part 131 constitutes one end of a single, long strap, the other end of which is comprised by the second leg strap 132. In this case, it is preferred that the upper engagement means is arranged to slidably engage with this long leg strap 131, 132, so that the leg strap 131, 132 can run around one of the user's legs, then through the slidable engagement with the protective cup 110 and finally around the second of the user's legs.

Since the leg strap parts 131, 132 in this case constitute different ends of a longer strap, their relative length can be adjusted by sliding the strap 131, 132 through the slidable engagement with the protective cup 110, so that the extension of the first leg strap 131 corresponds to a reduction of the length of the second leg strap 132 and vice versa. Such a strap 131, 132, in combination with such a slidable engagement, results in that the protective cup 110 can be retained with good fit and in a correct position even during very intensive and extreme motion on the part of the user, since the respective lengths of the two leg strap parts 131, 132 at all times adjust to fit the body position of the user without changing their combined length, which maintains a correct tension along the leg strap device 130.

According to the preferred embodiment which is illustrated in FIGS. 1*a* and 1*b*, the slidable engagement is realized by the upper engagement means comprising a pair of through holes 111, 112 in the upper part 117 of the protective cup 110, arranged at the upper parts of the respective side edges 118 of the protective cup 110, and by these through holes 111, 112 are arranged to receive and slidably accommodate the leg strap 131, 132. This admits an uncomplicated yet robust construction.

In this embodiment, it is also preferred that both leg strap parts 131, 132 are arranged to engage with and run between the lower engagement means 115 and the upper engagement means 111, 112. This maximizes the respective length of the leg strap parts 131, 132, and thereby increases the flexibility of the protective cup 110 which results in a good fit during intensive movements.

Furthermore, it is preferred that the lower engagement means also comprises a through hole 115 in the protective cup 110, which hole 115 is arranged to receive and slidably accommodate the leg strap device 130. In other words, the leg strap device 130 can be brought and run through the hole 115. Furthermore, the leg strap device 130 preferably comprises a stopper device 140 (see FIG. 1*b*), arranged along the part of the leg strap device 130 which in turn is arranged to be introduced through the through hole 115, suitably at the end of the leg strap device 130. The stopper device 140 is in this case arranged with a cross-sectional area which is larger than a cross-sectional area of the hole 115, so that the stopper device 140 at least in one predetermined position cannot pass through the hole 115. Thereby, the stopper device 140 is arranged to, via abutment against the surface of the protective cup 110 around the hole 115, limit the freedom of motion of the leg strap device 130 out from the hole 115, whereby a tensional force may be applied to the leg strap device 130 around the user's legs according to the above.

It is preferred that the stopper device 140 is adjustable, so that the user may adjust the tensional force in the leg strap device 130 by adjusting the position of the stopper device 140 along the leg strap device 130, and thereby the length of the leg strap device 130 which is brought through the hole 115, and as a consequence a length of the leg strap device 130 running around the user's legs. According to an especially preferred embodiment, the stopper device 140 comprises a cord lock by the use of which the leg strap device 130 can be tightened.

It is preferred that the leg strap device 130 is arranged to be brought through the hole 115 through the protective cup 110 from the outside in, so that the stopper device 140 is arranged on the inside of the protective cup 110 during use.

In a way which corresponds to the leg strap device 130, the waist strap 120 is, according to a preferred embodiment, arranged to run freely through a pair of through holes 113, 114 in the upper part 117 of the protective cup 110, which holes 113, 114 are arranged at the respective upper side edges of the protective cup 110. This gives an improved fit since the protective cup 110 to a certain extent can run along the waist strap 120 while the tensional force is maintained in the latter.

It is especially preferred, particularly in the case which is shown in FIGS. 1*a* and 1*b*, namely when both the upper engagement means in the protective cup 110 for the leg strap device 130 and the engagement means in the protective cup 110 which is arranged to engage with the waist strap 120 are in the form of through holes 111, 112; 113, 114, that the engagement means for the waist strap 120 and the leg strap device 130, respectively, are two separate engagement means. In other words, it is preferred that the protective cup 110 comprises two pairs of through holes 111, 112 and 113, 114, respectively, for accommodating the leg strap device 130 and the waist strap 120, respectively. Such a construction gives a good fit and avoids the problem of poor slidability for both the waist strap 120 and the leg strap device 130, without leading to expensive construction complexity.

Furthermore, it is preferred that the engagement means for the waist strap 120 is arranged to engage with the waist strap 120 at a location on the protective cup 110 which is closer to the lower part 116 of the protective cup 110 than what is the case for the upper engagement means for the leg strap device 130. This way, the point or points of engagement for the leg strap parts 131, 132 will be arranged as far from the lower point of engagement 115 as possible, which results in that the positive effect on the fit which is caused by the tensional force from the leg strap device 130 is maximized.

FIGS. 1*a*, 1*b* illustrate an exemplifying way in which the waist strap 120 and leg strap device 130, respectively, can be arranged to run through respective through holes 113, 114 and 111, 112, respectively, through a protective cup 110. As is clear from these figures, the waist strap 120 is arranged to run between the two through holes 113, 114 on the inside of the protective cup 110, in other words the side which is arranged to face towards the user's body during use. The leg strap device 130 is, in a corresponding way, arranged to run between the through holes 111, 112 on the inside of the protective cup 110.

Figure 2B:
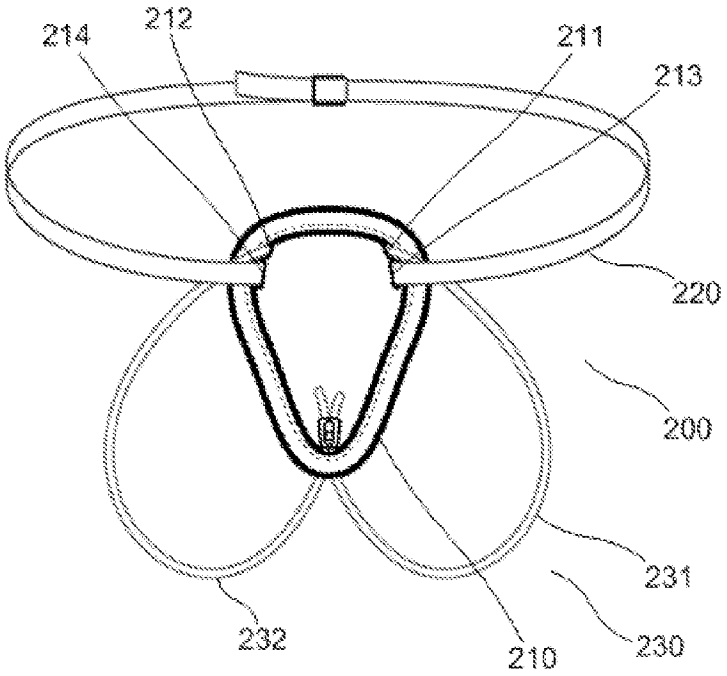
Figure 2A:
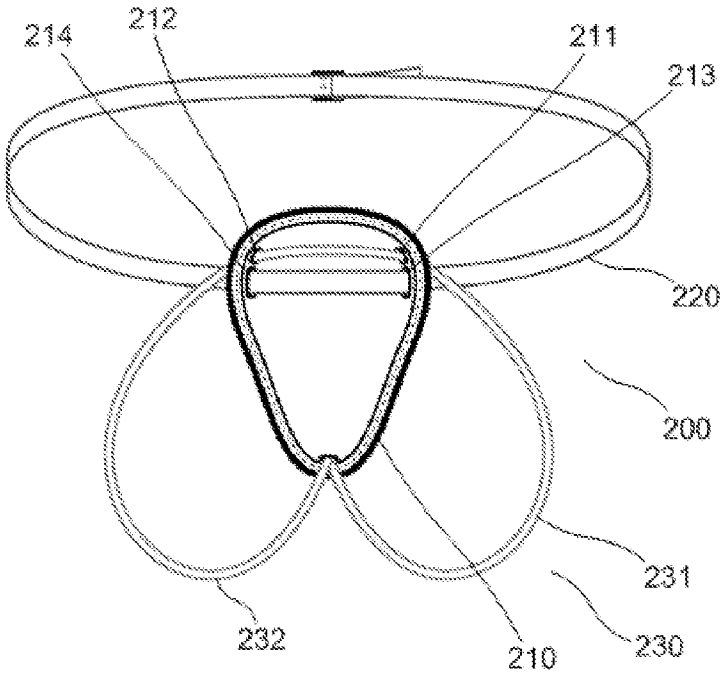

The protective cups 200, 300, 400 illustrated in FIGS. 2*a*, 2*b*; 3*a*, 3*b*; and 4*a*, 4*b* are similar to the protective cup illustrated in FIGS. 1*a* and 1*b*. In the following, the differences will be described.

FIGS. 2*a*, 2*b* illustrate a first alternative protective cup 200, in which a leg strap device 230, comprising first 231 and second 232 leg strap parts, are arranged to run between two through holes 211, 212 on the front side of a protective cup 210, while a waist strap 220 is also arranged to run between two through holes 213, 214 on the front side of the protective cup 210.

Figure 3B:
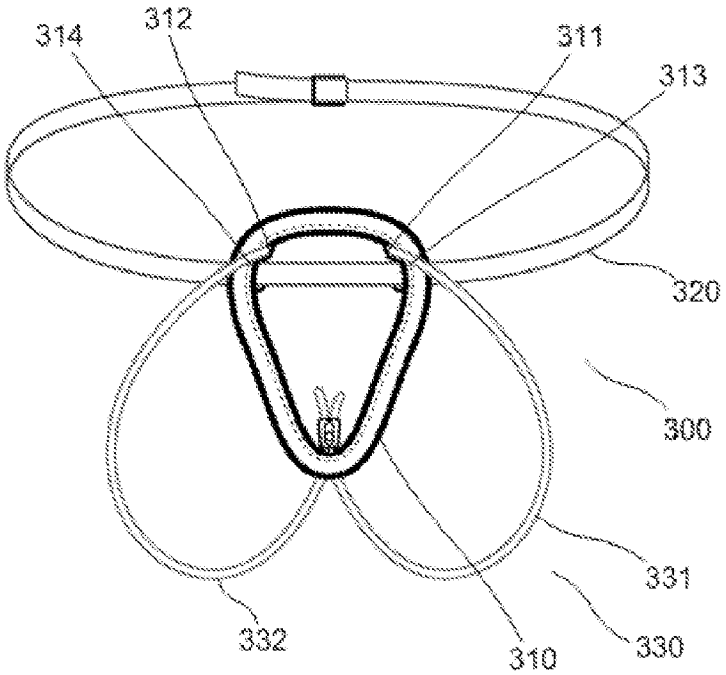
Figure 3A:
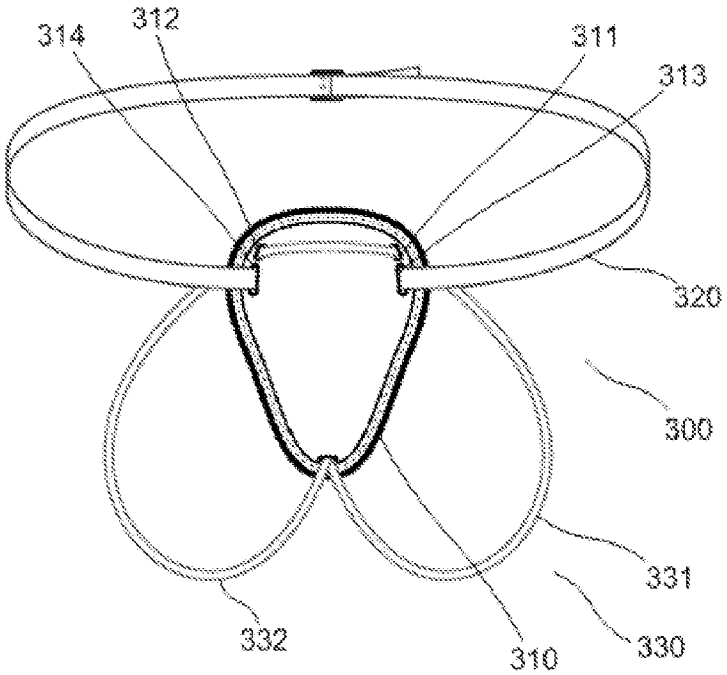

FIGS. 3*a*, 3*b* illustrate a second alternative protective cup 300, in which a leg strap device 330, comprising first 331 and second 332 leg strap parts, is arranged to run between two through holes 311, 312 on the front side of a protective cup 310, while a waist strap 320 is arranged to run between two through holes 313, 314 on the rear side of the protective cup 310.

Figure 4B:
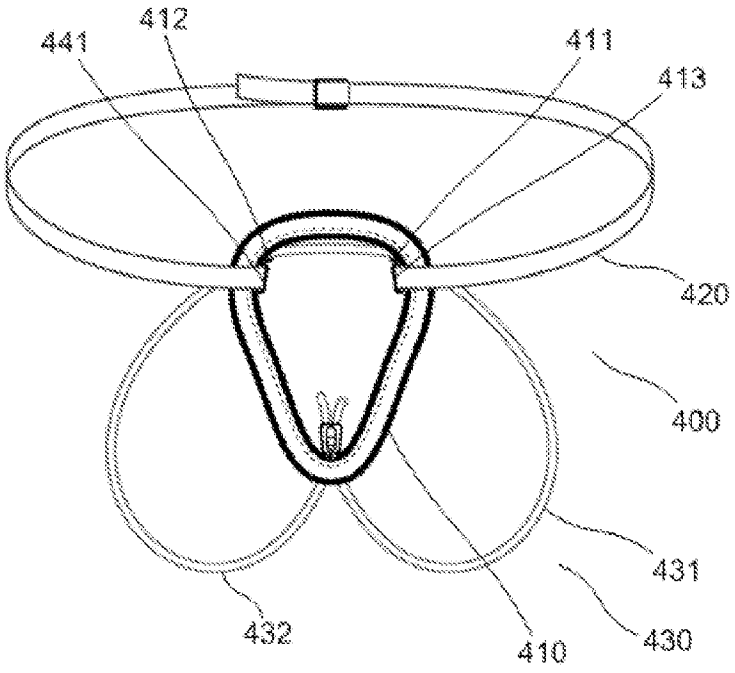
Figure 4A:
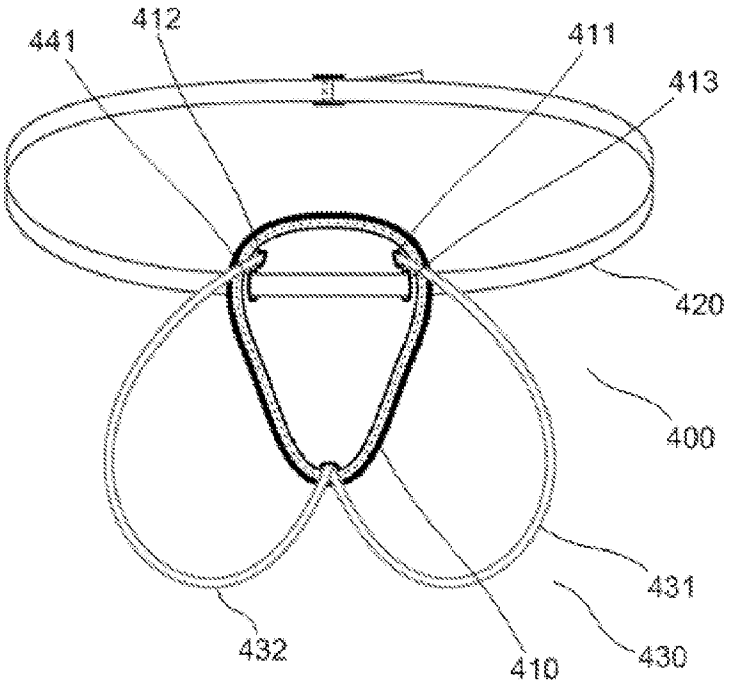

FIGS. 4*a*, 4*b* illustrate a third alternative protective cup 400, where a leg strap device 430, comprising first 431 and second 432 leg strap parts, is arranged to run between two through holes 411, 412 on the rear side of a protective cup 210, while a waist strap 420 is arranged to run between two through holes 413, 414 on the front side of the protective cup 410.

Thus, the protective cup 100, 200, 300, 400 may be designed so that the leg strap device 130, 230, 330, 430 and the waist strap 120, 220, 320, 420 are only arranged to run between the hole pairs in the corresponding engagement means in the protective cup 110, 210, 310, 410 in a certain predetermined of the above described ways. Different such variants have different advantages for different sports and for different body builds and styles.

According to a preferred embodiment, the protective cup 110, 210, 301, 410 is, however, arranged with through holes 111-114, 211-214, 311-314, 411-414, all of which are arranged in sufficient proximity to the edges of the upper part of the protective cup in order for the waist strap 120 and the leg strap device 130, independently of each other, to be threadable in any of the alternative ways being shown in FIGS. 1*a*, 1*b*; 2*a*, 2*b*; 3*a*, 3*b*; and 4*a*, 4*b*, respectively. In order to facilitate this, it is preferred that the hole pairs 111, 113; 112, 114; 211, 213; 212, 214; 311, 313; 312, 314; and 411, 413; 412, 414, respectively, are arranged adjacent to each other along the said respective side edge 118, so that the waist strap 120 and the leg strap device 130 do not have to cross or partly overlap each other between the through holes. Such a configuration will allow the user to quickly and simply adapt the threading of waist strap and leg strap device to the present situation.

Finally, it is preferred that the leg strap parts 131, 132 are elastic.

A protective device according to the present invention solves the initially described problems with no need for expensive construction complexity. In particular, and preferably, it is possible to design a protective device according to the present invention as a protective cup in molded rigid plastic comprising the holes 115, 111-114; a waist strap in the form of a strap, a leg strap part in the form of one single elongated strap; and tightening devices 104, 140. Such a construction is simple and therefore inexpensive to manufacture. Moreover, it is easy to use and adapt during use. It is easily demounted for cleaning and is not bulky.

Above, preferred embodiments have been described. However, it is apparent to the skilled person that many modifications may be made to the described embodiments without departing from the idea of the invention.

For example, the leg strap device 130 may be fixedly and not adjustably attached to the engagement means 115, and in return the leg strap device 130 may comprise a tightening device for adjusting its length, for example in the form of an individual adjustment device in each respective leg strap part 131, 132.

Furthermore, the leg strap part 130 may be slidably connected to the engagement means 115 without using a stopper device 140, for example by the leg strap part 130 running through one or several through holes in the lower part 116 of the protective cup 110 in a way similar to the slidable engagement between the leg strap part 130 and the holes 111, 112, i.e. so that the leg strap parts 131, 132 comprise two parts of the same longer strap, which longer strap is arranged to slidably rung through the engagement means 115.

Thus, the invention shall not be limited to the described embodiments, but may be varied within the scope of the enclosed claims.

The invention claimed is:

1. Protective equipment for protection of lower abdominals and genital body parts of a user, the protective equipment comprising:

a rigid protective cup with a rigid upper part and a rigid lower part, the upper part of the rigid protective cup including a pair of through holes and the lower part including a through hole;

a waist strap arranged to engage with and retain the protective cup on the user's body in a position in which the protective cup hangs down with its lower part downwards and covers the genital body parts of the user; and a leg strap device arranged to engage with and retain the protective cup in a position close to the user's body, the leg strap device comprises two leg strap parts, each of the leg strap parts being arranged to run around one respective leg of the user, wherein the leg strap device is arranged to engage with and pass into the through hole in the lower part of the rigid protective cup, and backwards between the user's legs, and in that the leg strap parts are arranged to run up to and engage with and pass through the pair of through holes in the upper part of the rigid protective cup, wherein the two leg strap parts are comprised by two parts of one and the same single leg strap, and wherein at least one of the through holes is arranged to slidably engage with said leg strap, so that the leg strap can run around one of the user's legs, then through said slidable engagement with the protective cup and then around the second of the user's legs.

2. Protective equipment according to claim 1, wherein each of the through holes in the upper part of the rigid protective cup is arranged at a respective upper side edge of the rigid protective cup, and said through holes are arranged to receive and slidably accommodate the leg strap.

3. Protective equipment according to claim 1, wherein both of the leg strap parts are arranged to engage with and run between the through hole in the lower part of the rigid protective cup and the pair of through holes in the upper part of the rigid protective cup.

4. Protective equipment according to claim 1, wherein the through hole in the lower part of the rigid protective cup is arranged to receive and slidably accommodate the leg strap device, and the leg strap device further comprises a stopper device, which stopper device is arranged along with the part of the leg strap device which is arranged to be inserted into the through hole and is arranged to limit the freedom of motion of the leg strap device out from said through hole by abutment against the protective cup.

5. Protective equipment according to claim 4, wherein the stopper device comprises a cord lock with the aid of which the leg strap device can be tightened.

6. Protective equipment according to claim 1, wherein the waist strap is arranged to run freely through a separate pair of through holes in the rigid protective cup, the separate pair of through holes being arranged at respective upper side edges of the protective cup.

7. Protective equipment according to claim 1, wherein the waist strap is arranged to engage with the protective cup at an engagement means which is separate from the pair of through holes in the upper part of the rigid protective cup, which separate engagement means is arranged to engage with the waist strap in a position on the protective cup which is closer to the lower part of the protective cup than the position at which the the pair of through holes is arranged to engage with the leg strap device.

8. Protective equipment according to claim 1, wherein the leg strap parts are elastic.

9. A protective device for protecting lower abdominal and genital regions of a user, the protective device comprising:

a protective cup with a rigid body having a rigid upper part that tapers to an adjacent rigid lower part;

a flexible waist strap attached to the upper part of the protective cup and configured to engage with and retain the protective cup on the body of the user such that the protective cup is positioned with the lower part pointing downwards and covering at least a portion of the genital region of the user; and first and second leg straps attached to the protective cup and configured to engage with and retain the protective cup close to the user's body, each of the leg straps being configured to wrap around a respective leg of the user, the first and second leg straps being attached to at least one through hole in the lower part of the rigid body of the protective cup, and attached to at least one through hole in the upper part of the rigid body of the protective cup, wherein the first and second leg straps are integral portions of a single leg strap, and wherein the single leg strap is slidably engaged with at least one of the through holes such that the single leg strap can run around one leg of the user, then through the slidable engagement with the protective cup, and then around a second leg of the user.

10. The protective device of claim 9, wherein the at least one through hole in the upper part of the rigid body comprises a pair of through holes in the protective cup configured to slidably receive therethrough the single leg strap, each of the through holes being positioned at a respective upper side edge of the protective cup.

11. The protective device of claim 10, wherein the first and second leg straps are arranged to engage with and run between the through holes in the lower and the upper parts of the rigid body of the protective cup.

12. The protective device of claim 9, wherein the at least one through hole in the lower part of the rigid body comprises a single through hole in the protective cup configured to slidably receive therethrough the single leg strap.

13. The protective device of claim 12, wherein the single leg strap comprises a stopper device positioned at a part of the single leg strap which is inserted into the through hole, the stopper device being configured to limit the freedom of motion of the leg single strap out from the through hole by abutment against the protective cup.

14. The protective device of claim 13, wherein the stopper device comprises a cord lock operable to tighten the leg single strap.

15. The protective device of claim 9, wherein the waist strap is configured to slide freely through a pair of through holes in the protective cup, each of the through holes being arranged at a respective upper side edge of the protective cup.

16. The protective device of claim 9, wherein the waist strap is arranged to engage with the protective cup at a distinct engagement segment which is separate from the at least one through hole in the upper part of the rigid body for the leg single strap, the distinct engagement segment being configured to engage with the waist strap in a position on the protective cup which is closer to the lower part of the protective cup than the position at which the upper engagement segment is arranged to engage with the leg single strap.

17. The protective device of claim 9, wherein the single leg strap comprises an elastic material.

* * * * *